US007204659B2

(12) United States Patent
Schmitt et al.

(10) Patent No.: US 7,204,659 B2
(45) Date of Patent: Apr. 17, 2007

(54) SCREED BAR FOR VIBRATORY SCREED

(75) Inventors: Michael W. Schmitt, Allenton, WI (US); Paul M. Sina, Jackson, WI (US)

(73) Assignee: M-B-W Inc., Slinger, WI (US)

( * ) Notice: Subject to any disclaimer, the term of this patent is extended or adjusted under 35 U.S.C. 154(b) by 0 days.

(21) Appl. No.: 11/017,533

(22) Filed: Dec. 21, 2004

(65) Prior Publication Data

US 2006/0133896 A1 Jun. 22, 2006

(51) Int. Cl.
*E01C 19/22* (2006.01)

(52) U.S. Cl. ..... 404/118

(58) Field of Classification Search ..... 404/114, 404/118; 15/235.4
See application file for complete search history.

(56) References Cited

U.S. PATENT DOCUMENTS

| | | | | | |
|---|---|---|---|---|---|
| 1,166,399 | A | * | 12/1915 | Brandt | 52/731.2 |
| 1,797,484 | A | * | 3/1931 | Smith | 15/235.4 |
| 1,952,398 | A | * | 3/1934 | Tullis | 33/533 |
| 3,018,499 | A | * | 1/1962 | Levy | 15/235.4 |
| 3,302,233 | A | * | 2/1967 | Sebastiani | 15/235.4 |
| 4,591,291 | A | | 5/1986 | Owens | |
| 4,650,366 | A | * | 3/1987 | Morrison | 404/114 |
| 4,701,071 | A | * | 10/1987 | Morrison | 404/114 |
| 4,989,390 | A | * | 2/1991 | Moore, III | 52/720.1 |
| 5,375,942 | A | | 12/1994 | Lindley et al. | |
| 5,460,461 | A | | 10/1995 | McGrath | |
| 5,540,519 | A | | 7/1996 | Weber | |
| 5,727,279 | A | * | 3/1998 | Pike, Jr. | 15/235.4 |
| 5,857,803 | A | * | 1/1999 | Davis et al. | 404/102 |
| 5,980,154 | A | | 11/1999 | Record | |
| 5,984,571 | A | | 11/1999 | Owens | |
| 6,200,065 | B1 | * | 3/2001 | Eitzen | 404/114 |
| 6,231,331 | B1 | | 5/2001 | Lievers | |
| 6,296,467 | B1 | | 10/2001 | Rouillard | |
| 6,705,799 | B2 | | 3/2004 | Piccoli | |
| 2003/0068200 | A1 | | 4/2003 | Quenzi et al. | |

OTHER PUBLICATIONS

Advanced Concrete Tools, Product Descriptions; Weber Concrete Tools—Products Page; http://www.concretescreed.com/products.htm; Oct. 25, 2003.

Magic Screeds; Allen Engineering Corporation Magic Screeds; http://www.alleneng.com/html_magicscreeds; Oct. 25, 2003.

* cited by examiner

*Primary Examiner*—Gary S. Hartmann
(74) *Attorney, Agent, or Firm*—Andrus, Sceales, Starke & Sawall, LLP

(57) ABSTRACT

A screed bar for a vibratory concrete screed is formed from a long hollow extrusion having generally flat enclosing walls and defining in cross section two triangular sections that share a common interior wall.

12 Claims, 2 Drawing Sheets

SCREED BAR FOR VIBRATORY SCREED

BACKGROUND AND SUMMARY

The present invention pertains to a manually operated, engine driven vibratory concrete screed and, more particularly, to an improved screed bar for such a screed.

Vibratory screeds are used to smooth the surface of freshly poured concrete and to eliminate air pockets within the concrete mass. One type of manually operated screed is driven by a small gasoline engine (e.g. 1 to 2.5 horsepower) that turns an eccentric exciter mechanism to impart a high speed vibratory force to a screed bar attached to the exciter mechanism. This type of vibratory screed includes an operating handle connected through a frame to the vibratory exciter and engine. The machine is pulled over the surface of the concrete and a small amount of fresh concrete will build up behind the bar to ensure that the surface is uniform and depressions are not created. The blade may be up to 24 feet in length, and, although vibration of the blade helps make the concrete flow, the operator must still pull the machine over the surface of the concrete.

Many types of screed bars have bee n used, arranging from relatively crude, solid wooden bars of rectangular cross-section to more sophisticated, hollow metal extrusions. In particular, long metal extrusions, typically made of magnesium or aluminum, have been made with a variety of cross-sections, including rectangular, triangular, trapezoidal and other various shapes.

It has been found, however, that in actual use, particularly as the length of the screed bar increases, the vibration is not uniformly distributed along the entire length of the bar and, as a result, the finishing of the surface of the concrete is not uniform. This lack of uniform distribution of vibration over the full length of the screed bar and the consequent non-uniform finishing of the concrete surface has been shown to occur in testing all of the various prior art screed bars. In addition, screed bar strength becomes increasingly important as the length of the screed bar increases. Even with the use of lightweight metal extrusions, the screed bar must have adequate stiffness to prevent excessive bending at longer screed bar lengths.

There remains a need, therefore, for a lightweight screed bar of adequate strength over the full length of which the vibrations may be more uniformly distributed so that the concrete surface is uniformly finished.

SUMMARY OF THE INVENTION

In accordance with the present invention, a screed bar having flat enclosing walls that define, in cross section, two triangular sections, sharing a common interior wall, provides both the increased strength and significantly enhanced uniformity in the distribution of vibration that has been absent in prior art constructions.

The screed bar comprises an elongate hollow member and, in a presently preferred embodiment, the common interior wall comprises a portion of one wall of one of the triangular sections and all of one wall of the other triangular section. In a particularly preferred embodiment, the triangular sections comprise generally equally sized isosceles right triangles. In this construction, the common wall comprises the hypotenuse of one of the triangular sections and a wall adjacent to the hypotenuse of the other triangular section. The wall comprising the hypotenuse of the other triangular section is the concrete-engaging finishing surface of the screed bar. The wall of the one triangular section that comprises the common wall extends angularly away from the other triangular section and joins a first adjacent wall of the one triangular section to form an angular mounting edge. The angular edge is preferably rounded. The first adjacent wall joins a second adjacent wall of the one triangular section to form a generally square mounting edge. The second wall includes a mounting groove located closely adjacent and parallel to the square mounting edge. The second adjacent wall includes a reinforcing rib that extends parallel to the square mounting edge.

In the preferred embodiment, the elongate hollow member forming the screed bar is preferably a metal extrusion. The metal from which the extrusion is formed is preferably magnesium.

DETAILED DESCRIPTION OF THE PREFERRED EMBODIMENT

Figure 1:
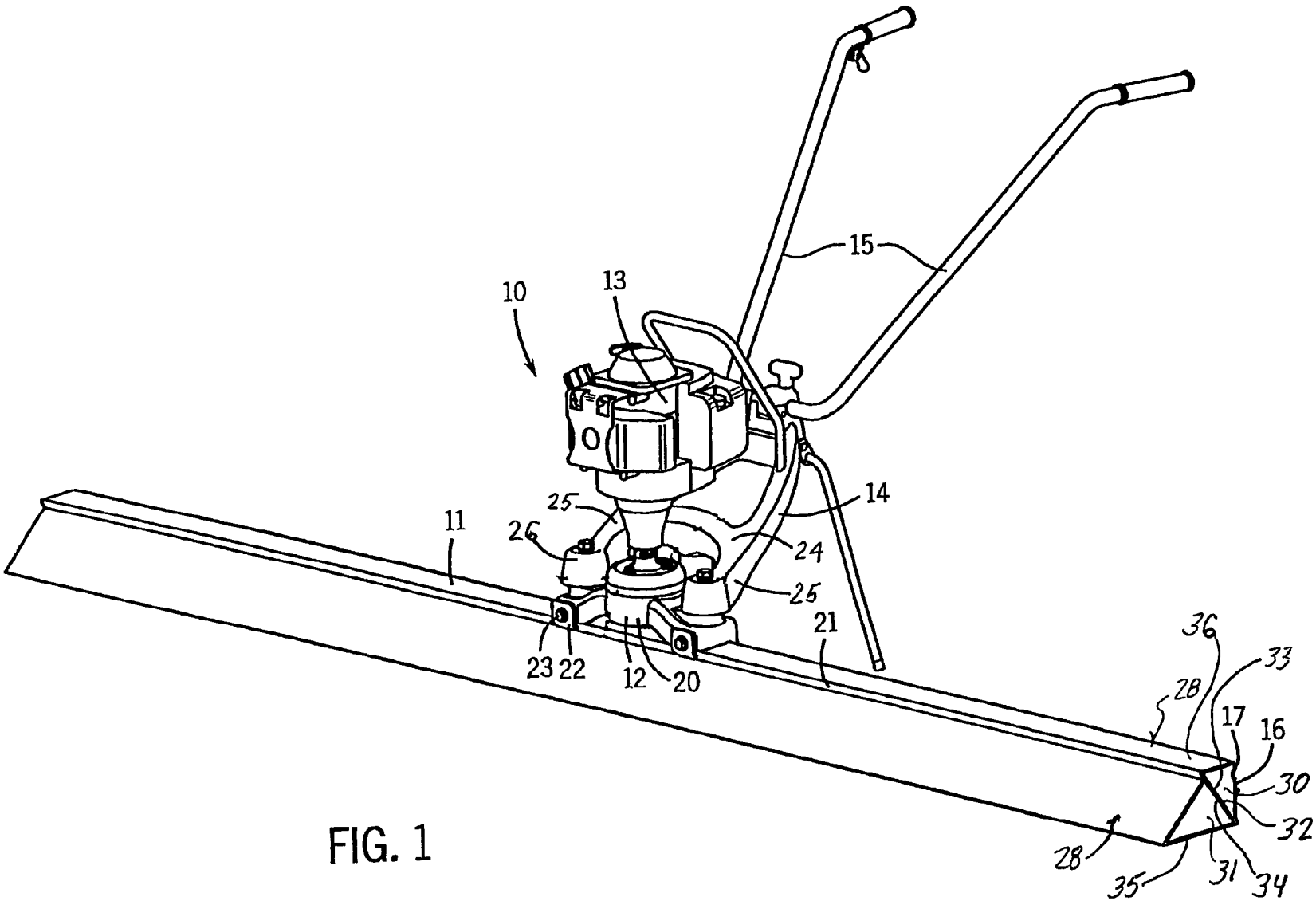
FIG. 1 is a perspective view of a vibratory screed including the screed bar of the present invention.

A vibratory concrete screed (10) includes a long blade or screed bar (11) which, in the preferred embodiment of the present invention is made from a magnesium extrusion. However, aluminum or other metals and metal alloys may also be used. The screed bar (11) may have a length of up to about twenty-four feet (about 8 m). The screed bar is clamped to the underside of an exciter mechanism (12) which includes an eccentric device driven by an engine (13) to impart a horizontal vibratory motion to the screed bar (11). A supporting frame (14) is attached to the exciter mechanism (12) an includes an operator handle (15). The screed (10) is operated over the surface of freshly poured concrete by the operator pulling the screed bar from the operator handle (15).

Figure 2:
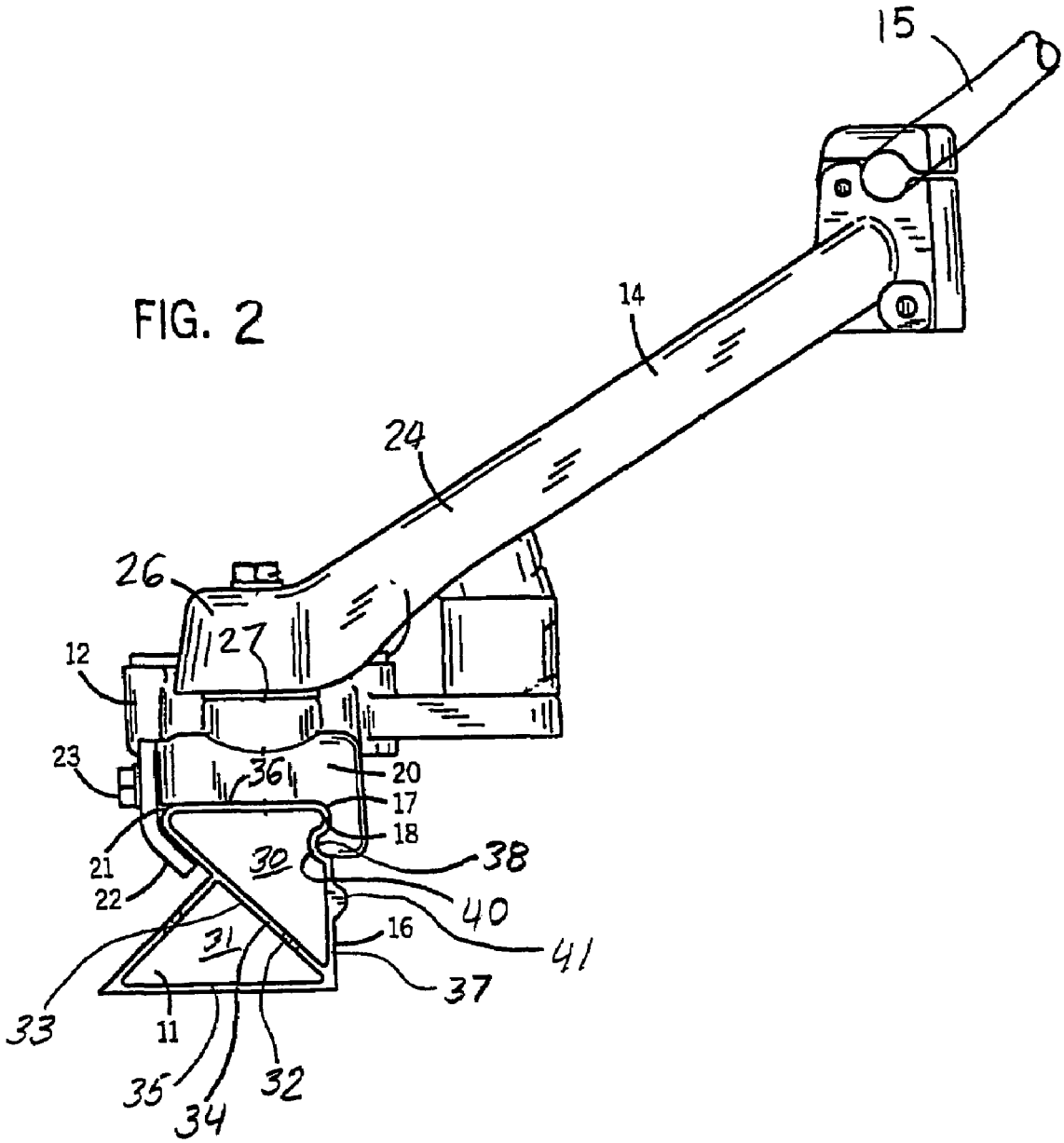
FIG. 2 is a side elevation of the vibratory screed shown in FIG. 1.

The screed bar (11) is demountably attached to the bottom of the exciter mechanism (12) such that the working face (16) of the screed bar faces the operator grasping the handles (15), whereby the screed may be pulled over the surface of the freshly poured concrete. As is best seen in FIG. 2, the upper edge of the working face (16) of the screed bar is provided with a horizontal mounting rib (17) that is received in a groove (18) in a casting that comprises a lower exciter housing (20). The front of the screed bar (11) also includes an upper horizontal rounded mounting surface (21) over which a pair of mounting clips (22) are attached to the housing (20) with machine screws (23).

Referring also to FIG. 1, the engine (13) is mounted vertically above and attached directly to the exciter housing (20) via a flexible elastomer coupling and vibration isolaters (not shown). The main supporting frame (14) includes a bifurcated lower frame member (24) that defines a pair of mounting arms (25) each of the arms (25) terminates in a downwardly opening cup (26) which encloses an elastomeric vibration isolator (not shown) providing means for attaching the isolator to the arm (25). The lower ends of the vibration isolators are, in turn, attached to a mounting surface (27) on the exciter housing (20) on opposite sides of the exciter mechanism (12). Details of the foregoing construction are shown in commonly owned U.S. patent application Ser. No. 10/706,539 entitled "Concrete Screed Width Vibration Isolation", filed Nov. 12, 2003, which is incorporated herein by reference.

In accordance with the present invention, the screed bar (11) that, as indicated above, is preferably made from a long hollow extrusion with generally flat enclosing outer walls. As shown in the drawings, the enclosing outer walls define a screed bar cross section that comprises a pair of adjoining triangular sections (28). The triangular sections (28), include a first triangular section (30) and a second triangular section (31) that share a common interior wall (32).

Each of the triangular sections (30 and 31) is in the general shape of an isosceles right triangle and the sections are generally equally sized. The common interior wall (32) is the hypotenuse (33) of the first triangular section (30) and a wall (34) adjacent to the hypotenuse of the second triangular section (31). Further, the triangular sections (30 and 31) are arranged such that the common interior wall (32) extends upwardly at an acute angle to the horizontal from the lower edge of the working face (16). The hypotenuse wall (33) of the first triangular section (30) extends angularly away from the second triangular section (31) and joins a horizontal first adjacent wall (36) of triangular section (30) to form the rounded mounting surface (21). The opposite edge of the first adjacent wall (36) joins the second wall (37) adjacent to the hypotenuse of the first triangular section to form a mounting edge comprising the mounting rib (17). As indicated above, the mounting rib is preferably rounded to accommodate the groove (18) in the exciter housing (20). Furthermore, the wall (37) includes a longitudinal groove (38) for receipt of a corresponding rib (40) on the exciter housing to hold the screed bar in place after the mounting clips (22) have been attached. Approximately midway on the second wall (37) of the first triangular section (30), there is formed a horizontal deflector rib (41) which helps prevent concrete from building up against the working face (16) of the screed bar. The deflector rib also serves to further stiffen the bar.

It has been found that the above described specific triangular cross-section comprising two triangular sections (30 and 31) sharing a common interior wall (32) distributes the vibration imparted to the screed bar more uniformly along its entire length, as compared to prior art screed bars. The more uniform distribution of vibration is maintained even in screed bar lengths up to twenty-four feet (about 8 m). The common interior wall (32) also provides a much stiffer and stronger section.

It is not known why the two triangular sections joined by a common wall provides the improved distribution of vibration. However, it appears that the amplitude of the vibrations generated by the exciter mechanism (12) remains more uniform along the entire length of the bar (11). This uniformity was not found in testing other screed bar constructions, including single triangular sections and trapezoidal sections.

What is claimed is:

1. A screed bar for a vibratory concrete screed comprising a unitary elongate hollow member made from a single metal extrusion, said member having elongate flat enclosing walls, said walls extending the length of the bar, the lowermost of said walls comprising an uninterrupted planar concrete finishing face, and said walls defining in cross-section first and second triangular screed bar sections sharing a common elongate interior wall, said common interior wall disposed at an acute angle to the horizontal, and said common interior wall comprising a portion of one wall of the first triangular section and all of one wall of the second triangular section.

2. The screed bar as set forth in claim 1 wherein said triangular sections comprise substantially right triangles.

3. The screed bar as set forth in claim 2 wherein the common wall comprises a portion of the hypotenuse of the first triangular sections.

4. The screed bar as set forth in claim 3 wherein the common wall comprises a wall adjacent to the hypotenuse of the second triangular section.

5. The screed bar as set forth in claim 4 wherein the wall comprising the hypotenuse of said second triangular section comprises the concrete finishing face.

6. The screed bar as set forth in claim 5 wherein the wall of said first triangular section comprising the common wall extends angularly away from said second triangular section and joins a first adjacent wall of said first triangular section to form an angular mounting edge.

7. The screed bar as set forth in claim 6 wherein said angular edge is rounded.

8. The screed bar as set forth in claim 7 wherein said first adjacent wall joins a second adjacent wall of said first triangular section to form a second mounting edge.

9. The screed bar as set forth in claim 8 wherein said second adjacent wall includes a mounting groove closely adjacent and parallel to said square mounting edge.

10. The screed bar as set forth in claim 8 wherein said second adjacent wall includes a deflector rib parallel to said second mounting edge.

11. The screed bar as set forth in claim 1 wherein the metal is magnesium.

12. The screed bar as set forth in claim 1 wherein a remaining portion of said one wall of the first triangular section outside said common interior wall forms, with an adjacent wall of said first triangular section, a screed bar mounting edge.

* * * * *